US010065786B2

(12) United States Patent
Kuhn

(10) Patent No.: US 10,065,786 B2
(45) Date of Patent: Sep. 4, 2018

(54) TRANSPORT CONTAINER

(71) Applicant: VA-Q-TEC AG, Würzburg (DE)

(72) Inventor: Joachim Kuhn, Würzburg (DE)

(73) Assignee: VA-Q-TEC AG, Würzburg (DE)

( * ) Notice: Subject to any disclaimer, the term of this patent is extended or adjusted under 35 U.S.C. 154(b) by 0 days.

(21) Appl. No.: 15/121,521

(22) PCT Filed: Oct. 19, 2015

(86) PCT No.: PCT/EP2015/002065
§ 371 (c)(1),
(2) Date: Aug. 25, 2016

(87) PCT Pub. No.: WO2016/070956
PCT Pub. Date: May 12, 2016

(65) Prior Publication Data

US 2017/0233165 A1 Aug. 17, 2017

(30) Foreign Application Priority Data

Nov. 7, 2014 (DE) ..... 20 2014 008 814 U

(51) Int. Cl.
*B65D 81/38* (2006.01)

(52) U.S. Cl.
CPC ..... *B65D 81/3813* (2013.01)

(58) Field of Classification Search
CPC ..... B65D 81/3813; B65D 81/3823; B29C 43/203; B29C 44/06
(Continued)

(56) References Cited

U.S. PATENT DOCUMENTS 5,100,016 A * 3/1992 Wischusen, III ..... B65D 5/248 229/103.11
5,154,309 A 10/1992 Wischusen, III et al.
(Continued)

FOREIGN PATENT DOCUMENTS

DE 69609063 3/2001
DE 10301318 8/2004
(Continued)

OTHER PUBLICATIONS

International Search Report, PCT/EP2015/002065, dated Dec. 22, 2015.
(Continued)

*Primary Examiner* — Christopher Demeree
(74) *Attorney, Agent, or Firm* — Andrus Intellectual Property Law, LLP

(57) ABSTRACT

A transport container has an outer container with a bottom, two sets of side walls and at least one lid. Vacuum insulation panels are arranged on the inside of the outer container, at least on the side walls. First vacuum insulation panels on first side walls which are located opposite one another, abut at the edges against inside surfaces of second vacuum insulation panels on second side walls, which are located opposite one another and on the bottom. The first vacuum insulation panels are realized as planar rectangular-shaped vacuum insulation panels with a thickness D. The second vacuum panels are realized as panels with a sealing edge that comprises a certain residual width B. The thickness D is greater than the residual width B. The edges of the first vacuum insulation panels cover the sealing edges of the second vacuum insulation panels and otherwise abut against adjoining planar surfaces of the second vacuum insulation panels.

26 Claims, 6 Drawing Sheets

(58) Field of Classification Search
USPC ..... 229/103.11, 122.32, 122.34, 930; 220/592.2, 592.26, 292.27
See application file for complete search history.

(56) References Cited

U.S. PATENT DOCUMENTS

| | | | | |
|---|---|---|---|---|
| 6,220,473 | B1 * | 4/2001 | Lehman | B65D 81/3858 150/901 |
| 6,325,281 | B1 * | 12/2001 | Grogan | B65D 81/3862 220/592.25 |
| 7,500,593 | B2 * | 3/2009 | Mayer | B65D 81/3816 220/592.2 |
| 2009/0071088 | A1 * | 3/2009 | Viegas | B62D 33/048 52/406.1 |
| 2010/0314397 | A1 | 12/2010 | Williams et al. | |
| 2010/0326993 | A1 | 12/2010 | Mayer et al. | |
| 2013/0149481 | A1 | 6/2013 | Hiemeyer et al. | |

FOREIGN PATENT DOCUMENTS

| | | |
|---|---|---|
| DE | 102010019074 | 11/2011 |
| EP | 1384685 | 1/2004 |
| EP | 2221569 | 8/2010 |
| EP | 2514680 | 10/2012 |
| WO | 1996032605 | 10/1996 |
| WO | 1997012100 | 4/1997 |
| WO | 2004104498 | 12/2004 |
| WO | 2007033836 | 3/2007 |
| WO | 2008137883 | 11/2008 |
| WO | 2009017796 | 2/2009 |
| WO | 2012085212 | 6/2012 |

OTHER PUBLICATIONS

International Preliminary Report on Patentability, PCT/EP2015/002065, dated May 9, 2017.

* cited by examiner

TRANSPORT CONTAINER

CROSS-REFERENCE TO RELATED APPLICATIONS

This application is the U.S. national stage application of International Application PCT/EP2015/002065, filed Oct. 19, 2015, which international application was published on May 12, 2016, as International Publication WO 2016/070956 in the English language. The International Application claims priority of German Patent Application No. 202014008814.4, filed Nov. 7, 2014. The international application and German application are both incorporated herein by reference, in entirety.

FIELD

The invention relates to a transport container.

BACKGROUND

The known transport container, from which the invention proceeds (WO 2008/137883 A1), is intended and suitable for the transport of temperature-sensitive products, in particular products that are sensitive regarding temperature fluctuations in the interior. Such products are, for example, certain pharmaceuticals, donor organs, blood reserves, but also artworks, etc., which are sensitive to fluctuations in temperature.

The known transport container, from which the invention proceeds, has a box-shaped outer container produced from corrugated board, from corrugated plastic, where applicable also from metal or from a combination of such materials. Plastic twin-wall sheets or plastic multi-skin sheets in a thin-walled design are occasionally referred to in practice as corrugated plastic.

The box-shaped outer container has a bottom, four side walls and at least one lid. In a particular case, four individual lids are provided, each of the individual lids being pivotably hinged on one of the four side walls. However, box-shaped transport containers where only one single, complete lid is pivotably hinged on one of the four side walls are also known.

In order to keep the temperature in the interior of the container uniform for as long as possible, plate-shaped vacuum insulation panels are situated in the outer container arranged on the side walls covering the surface.

Vacuum insulation panels are known per se and are described in the prior art which provides the starting point for the present invention (WO 2008/137889 A1). All the information concerning vacuum insulation panels can be found in detail in the further prior art (WO 2004/104498 A2).

It is essential that thermal bridges do not exist between the interior of the box-shaped transport container, which serves for receiving the product to be transported, and the ambient atmosphere, consequently therefore basically the box-shaped outer container itself. This is why it is important to minimize the gaps between the vacuum insulation panels. This occurs, for example, as a result of matching the box-shaped outer container as precisely as possible to the outside dimensions of the vacuum insulation panels which are arranged on the side walls covering the surface.

In the case of the previously explained, known box-shaped transport container, all the plate-shaped vacuum insulation panels of the side walls are configured in a rectangular-shaped manner with planar edges and are arranged in a circumferential manner in the box-shaped outer container in each case abutting against one edge and freely protruding at the other edge. In the case of a cubic outer container, it is possible, as a result, to produce all of the plate-shaped vacuum insulation panels provided on the side walls with the same dimensions, that is to say to use practically only one size of vacuum insulation panel.

From a different prior art (EP 2 221 569 A1), it is known, having the same objective, to configure the plate-shaped vacuum insulation panels of the side walls in a rectangular-shaped manner, but with edges beveled and mitered to 45°, and to arrange them mitered and abutting against one another. Here too, the same result is obtained for a cubic outer container, namely the use of only one size of vacuum insulation panel for the entire outer container.

In general, it is also still possible to provide plate-shaped latent heat storage elements or latent heat storage elements that are developed in another manner inside the box-shaped outer container making it possible to keep the temperature uniform in the interior of the transport container over a very long time and where the outside temperatures fluctuate a great deal (see also WO 2008/137883 A1). There are the same options for the outer shape of the latent heat storage elements as for the previously explained plate-shaped vacuum insulation panels (see WO 2008/137883 A1 and EP 2 221 569 A1).

As is produced from the prior art already addressed above, a vacuum insulation panel regularly consists of an open-pore support core and a gas-tight covering, regularly produced from corresponding film material (high barrier films). Sometimes a drying substance or a substance for binding gas molecules is also situated in the open-pore support core. The support core of a vacuum insulation panel has to meet various demands (see Wikipedia "vacuum insulation panel"). There are various substances for the material of the support core, namely typically open-pore plastics materials, microfiber material, pyrogenic silica and perlite.

In general, a finished vacuum insulation panel has a large flat body with planar surfaces and an edge region which is configured more or less precise in form.

To produce a vacuum insulation panel, it is possible to work with a core material which has been pressed previously to provide the final form, that is to say to provide a block or to provide a mechanically stable panel (DE 10 2010 019 074 A1). Then, as a result of skilled folding and working-and-turning the high barrier film, a vacuum insulation panel can be achieved, the edges of which are planar and accordingly themselves form planar contact surfaces. Such a vacuum insulation panel can easily be used in an outer container because the gaps between the vacuum insulation panels can be kept small and thermal bridges are accordingly able to be efficiently reduced.

However, vacuum insulation panels are also produced with a bulk powder core or with a core produced from microfiber material which is also filled loosely into the interior of the high barrier film. Such a vacuum insulation panel is not brought into its final plate-shaped form until the core material has been filled in. The outer covering of such a vacuum insulation panel consists of high barrier films which are welded flatly to one another along their circumferential edges or are connected together in a flat manner in some other way (WO 2007/033836 A1). This is called a sealing edge. Regularly, in the case of a sealing edge, the circumferential edge of the vacuum insulation panel with the wide weld seam that extends there or with a correspondingly bonded edge strip is somewhat irregular. A sealing edge is, as regards the gap, therefore more difficult to seal than a planar edge of a vacuum insulation panel with a plate-shaped core.

Vacuum insulation panels with a plate-shaped core are clearly more expensive to produce than vacuum insulation panels with a bulk powder core or with a core produced from microfiber material. Consequently, there is a conflict of objective between the desire for good heat insulation, that is to say the efficient avoidance of thermal bridges, on the one hand, and the costs of a correspondingly efficient transport container on the other.

Apart from this, it is generally applicable in the case of transport containers of the type discussed that, with reference to the exterior volume, as large an interior volume as possible would be wanted for the transport of temperature-sensitive products. In particular, when used in air freight, a larger exterior volume immediately affects the freight costs. It would therefore be desirable to have the thickness of the necessary thermal insulation as small as possible.

Proceeding from the previously explained prior art, the problem underlying the teaching of the invention is to optimize the known transport container, from which the invention proceeds, as regards the thermal insulation both with consideration to a cost viewpoint and with consideration to the available interior volume in the case of predetermined exterior volumes.

SUMMARY

The problem indicated beforehand is solved for a transport container with the features described below.

According to the invention, in the interior of the outer container planar rectangular-shaped vacuum insulation panels are combined with vacuum insulation panels with a sealing edge. The planar rectangular-shaped vacuum insulation panels, which are complex and expensive to produce, are only used in the transport container according to the invention where they are absolutely necessary. The other inside surfaces of the outer container are covered with vacuum insulation panels with a sealing edge which are more cost-efficient to produce. These are sometimes even more efficient at thermal insulation than the planar rectangular-shaped vacuum insulation panels.

With regard to the avoiding of thermal bridges, it is possible to make the sealing edges of the corresponding vacuum insulation panels largely ineffective as a result of the sealing edges being completely covered by the outermost planar edges of the planar rectangular-shaped vacuum insulation panels. According to the invention, narrow gaps are also created here as the outermost planar edges of the first vacuum insulation panels abut at the outermost planar edges primarily against the planar surfaces of the second vacuum insulation panels, in this case, however, they cover the sealing edges of the second vacuum insulation panels at the same time.

The advantageous realizations provided in claims 2 to 4 apply to the development of the first and second vacuum insulation panels.

According to a further, independent teaching of the invention, to which particular importance is also attached, it is provided that the second vacuum insulation panels, which are also configured here as vacuum insulation panels with a sealing edge, are configured in a connected manner as a U-shaped component with formed bending zones on the second side walls and on the bottom or are configured in a connected manner as an O-shaped component with formed bending zones on the lid together with one second vacuum insulation panel.

With the connected development of the second vacuum insulation panels, in the case of the U-shaped or O-shaped component which is present here, in the otherwise available gaps we have the continuous bending zones inside the covering produced from high barrier film with equally high thermal insulation. In this case, thermal bridges are completely avoided.

The teaching of the invention explained beforehand is especially important in conjunction with the configuration of the second vacuum insulation panels as vacuum insulation panels with a bulk powder core or with a core produced from microfiber material. Said vacuum insulation panels are able to be used particularly well in a connected component of the described type.

With consideration to the demands for the exterior dimensions of the transport container, it can be further recommended that the thickness of the second vacuum insulation panels combined in the U-shaped or O-shaped component is considerably less than the thickness of the first vacuum insulation panels and preferably is only half as large as the thickness of the first vacuum insulation panels. In this case, two U-shaped or O-shaped components which correspond to one another can be arranged in two layers in the outer container. The U-shaped or O-shaped components should correspond to one another to the extent that they complement one another for providing a double-thickness vacuum insulation panel on each of the two side walls or on the bottom or, in the case of an O-shaped component, on the lid. The dimensions of the outside component will preferably be slightly larger than the dimensions of the inside component in order actually to be able to encompass the outside of the inside component effectively in a congruent manner.

The teaching explained beforehand considers that thinner vacuum insulation panels with a sealing edge can be combined with less production expenditure to form a U-shaped or O-shaped component. In addition, there is the advantage that in the bending zones in each case two evacuated strips of the respective coverings are situated one behind the other.

Further preferred designs and further developments are the object of further sub-claims.

BRIEF DESCRIPTION OF THE DRAWINGS

The invention is explained in more detail below by way of a drawing which simply shows preferred exemplary embodiments. In the case of the explanation of the drawing, particular advantages and characteristics as well as preferred designs and further developments of the transport container according to the invention are also described in detail. The drawing is as follows.

DETAILED DESCRIPTION

The figures in FIG. 1 to FIG. 4 are to be taken in connection with one another to begin with for the following realizations.

As has been explained in the general part of the description, there are different types of vacuum insulation panels which differ, in particular, by the form of the core material. Reference may be made to these configurations.

Figure 1:
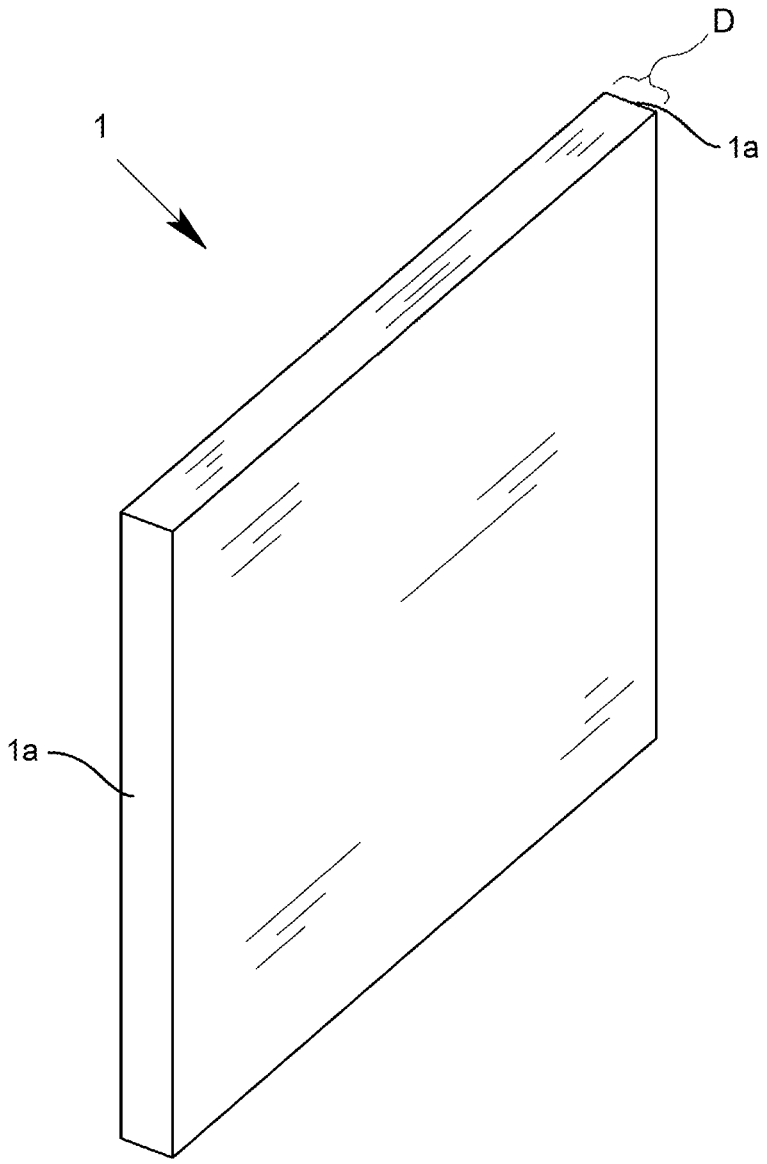
FIG. 1 shows a perspective view of a planar plate-shaped vacuum insulation panel.

FIG. 1 shows a perspective view of a first vacuum insulation panel 1 which is configured in a planar rectangular-shaped manner with a thickness D. The vacuum insulation panel 1 is a vacuum insulation panel with a core material, in particular produced from pyrogenic silica, which has been pressed beforehand to form the block or to form a mechanically stable panel. Reference may also be made in this respect to the prior art which has been described in the introduction. The advantage of the substantially rectangular-shaped vacuum insulation panel 1 is that it comprises planar edges such that gaps between adjoining vacuum insulation panels can be minimal. These types of planar rectangular-shaped vacuum insulation panels are used, for example, in the prior art produced from WO 2008/137883 A1 which has been explained in the introduction.

Figure 2:
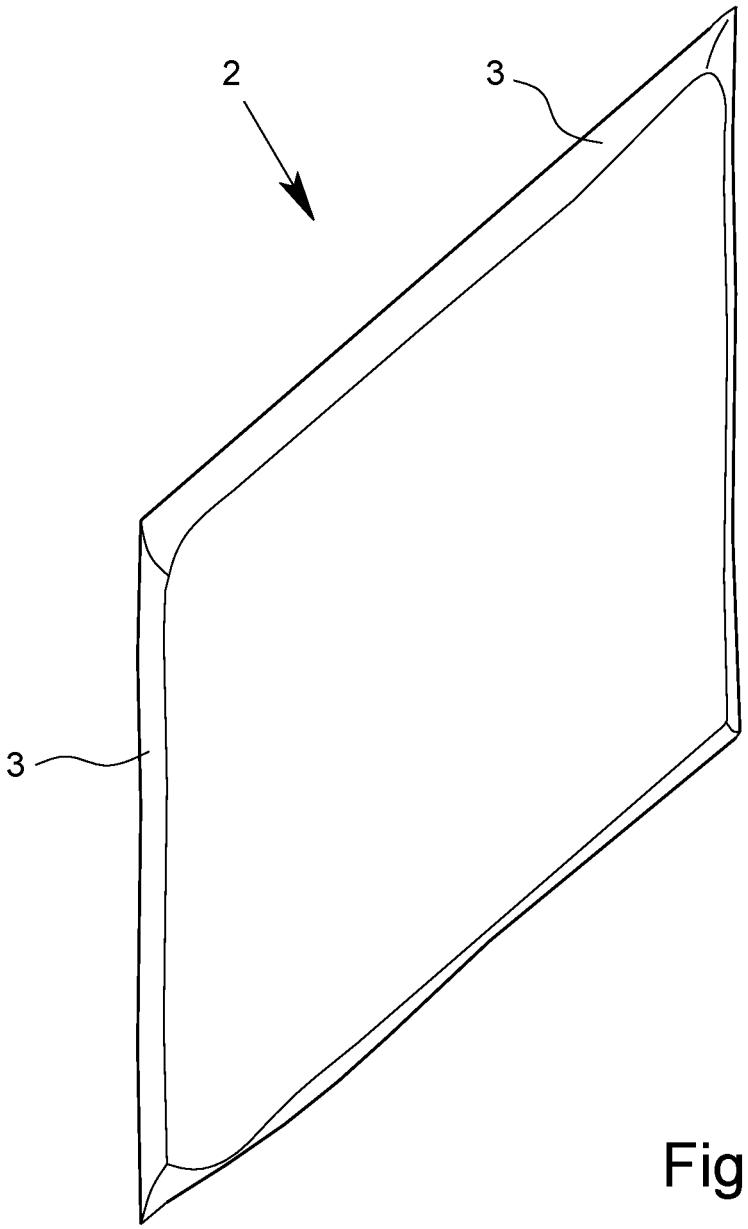
FIG. 2 shows a representation corresponding to FIG. 1 of a vacuum insulation panel with a ragged edge.

FIG. 2 shows a different vacuum insulation panel 2, namely one such with a sealing edge 3. Mention has been made in the introduction in this respect regarding the prior art (WO 2007/033836 A1). Reference may be made to these configurations.

Figure 3:
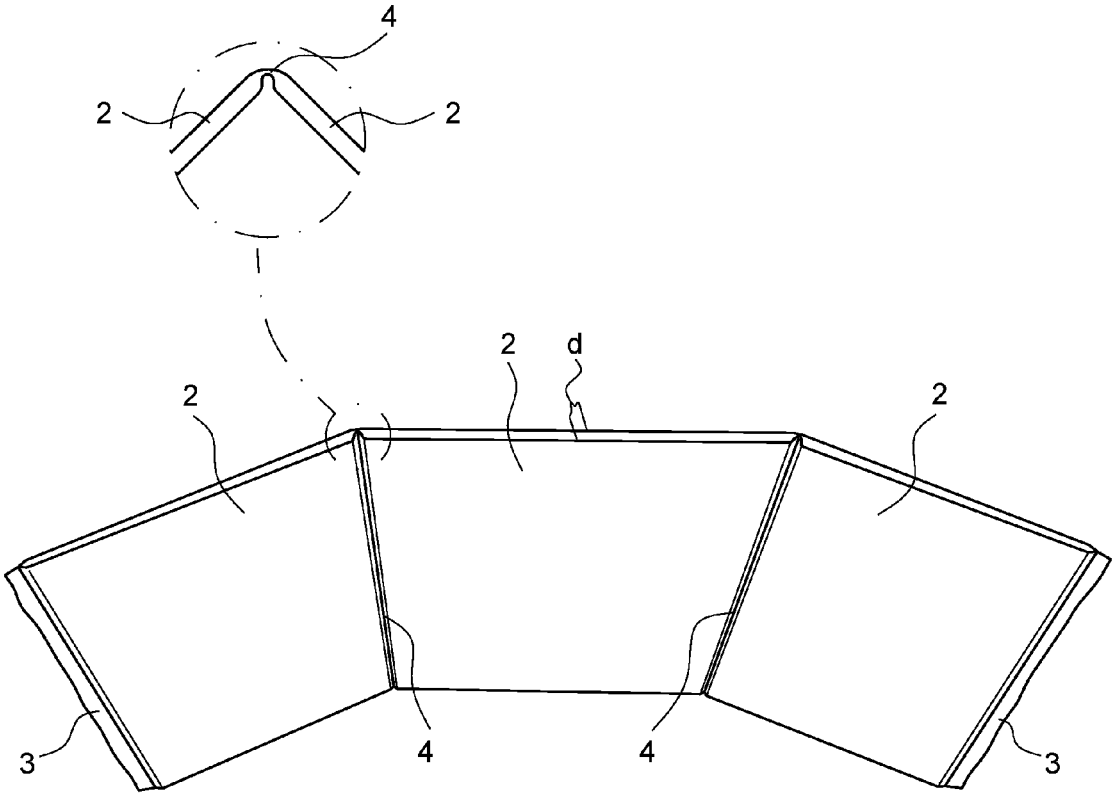
FIG. 3 shows a component which is arrangeable in a U-shaped manner produced from three second vacuum insulation panels with a ragged edge.

Vacuum insulation panels 2 with a sealing edge 3 can be incorporated in an expedient manner into a connected U-shaped component with formed bending zones 4 by means of a common gas-tight covering. This is shown in FIG. 3 for a U-shaped component with formed bending zones 4 which incorporates a total of three second vacuum insulation panels 2. The thickness of the vacuum insulation panels 2 is specified here by way of "d".

In the cutout highlighted by the dotted circle, it can be seen how considerable thermal insulation is still achieved in the bending zone 4 on account of the continuous material.

Figure 4:
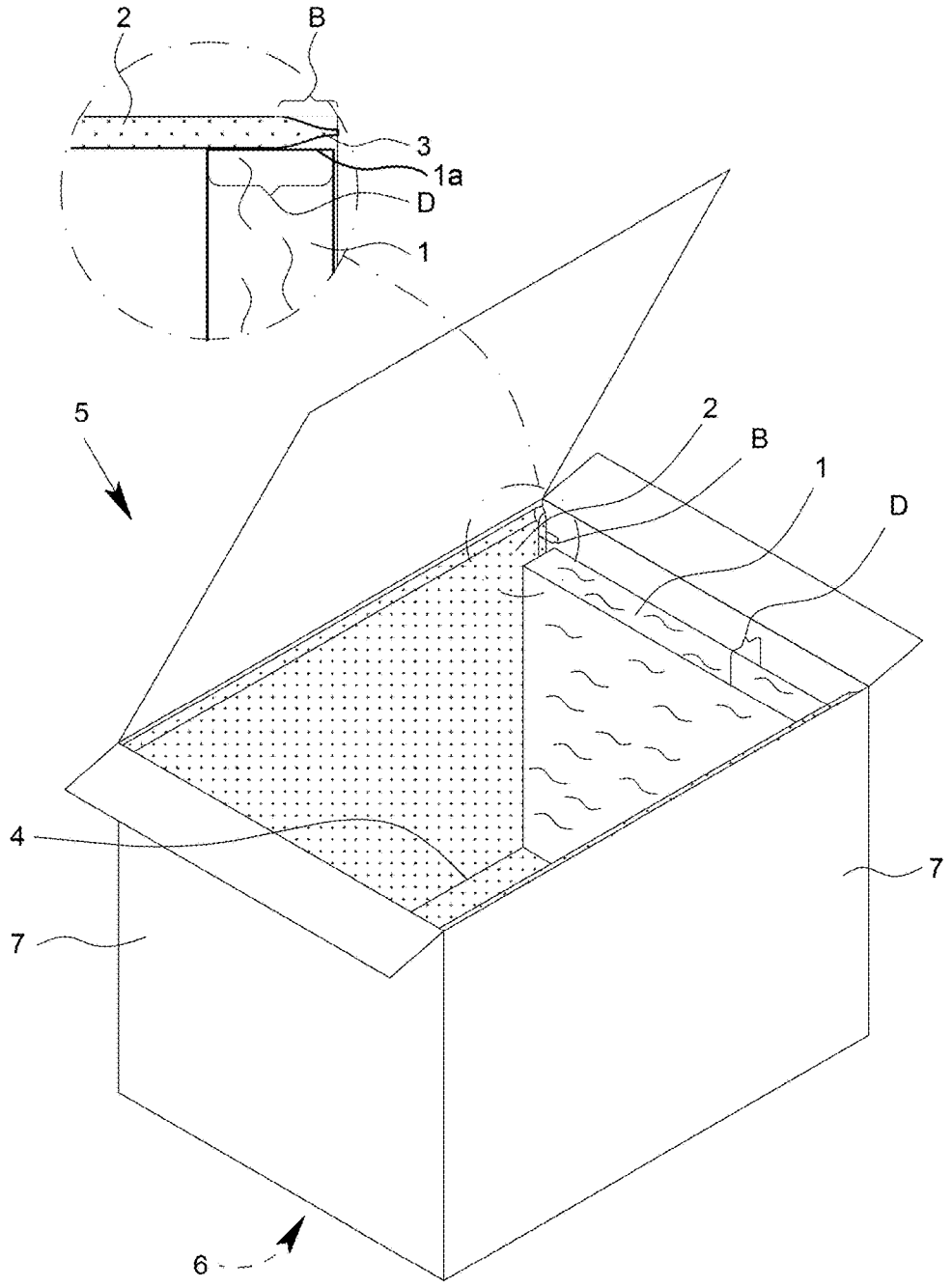
FIG. 4 shows a transport container according to the invention, open.

FIG. 4 initially shows a typical transport container having an outer container 5 with a bottom 6, two sets of oppositely situated side walls 7 and at least one lid 8.

All the examples quoted in the general part of the description are applicable to the design of the outer container 5. The outer container 5 can comprise one single lid 8 which is attached to one of the side walls 7 by means of a bending zone, it can also comprise one single separate lid or each of the oppositely situated side walls 7 has its own lid 8. It can be seen in FIG. 4 that vacuum insulation panels 1, 2 are arranged on the inside of the outer container 5 on the bottom 6 and on the side walls 7. It is not possible to see from FIG. 4 that this is also the case on the lid 8. However, it can be assumed from FIG. 4 that prior to the outer container 5 being closed, the top side of the interior in the outer container 5, which is open in FIG. 4, will be covered by a vacuum insulation panel 2.

First vacuum insulation panels 1 of the type shown in FIG. 1 are situated on first oppositely situated side walls 7, that is the side walls 7 shown on the left and the right in FIG. 4. Second vacuum insulation panels 2, are situated on the other two side walls 7, on the bottom 6 and preferably also on the lid 8, as are shown in FIG. 2.

The first vacuum insulation panels 1 on the first oppositely situated side walls 7 abut at the outermost planar edges 1*a* against the inside surfaces of the second vacuum insulation panels 2 which are arranged on the second oppositely situated side walls 7, on the bottom 6 and preferably also on the lid 8. The abutting can be seen on the right and left in FIG. 4. As a result of the abutment, here the outermost planar edges 1*a* of the first vacuum insulation panels 1 contact, at least over part of their surface, the planar surfaces of the second vacuum insulation panels 2. Narrow gaps are formed here and the thermal bridges generated are slight.

It is essential to the invention, as can also be seen in FIG. 4, that the second vacuum insulation panels 2 are configured in such a manner as shown in FIG. 2, namely with a sealing edge 3. The sealing edge 3 of a second vacuum insulation panel 2 can be compressed to a limited extent, that is, the sealing edge 3 has a different contour than the outermost planar edges 1*a* of the first vacuum insulation panels 1. It is then folded a little in an ordered manner. How extensively the folding is effected is determined by the interior dimensions of the outer container 5. The result is that the sealing edge 3 of the second vacuum insulation panels 2 inserted in the outer container 5 comprises a certain residual width which is designated in FIG. 4 by way of the reference "B".

It can be seen further in FIG. 4 that the first vacuum insulation panels 1, which are configured as planar rectangular-shaped vacuum insulation panels, comprise a certain thickness which is designated in FIG. 4 by way of the reference "D".

It is essential then that the thickness D is greater than the residual width B. It is preferably at least two times the residual width B. It is additionally essential that the vacuum insulation panels 1, 2 are arranged in such a manner that the outermost planar edges 1*a* of the first vacuum insulation panels 1 cover the sealing edges 3 of the second vacuum insulation panels 2. Consequently, the space, which the sealing edge 3 of a second vacuum insulation panel 2 inevitably allows to exist here, is securely covered by the planar edge of the rectangular-shaped, planar first vacuum insulation panel 1. Only a narrow gap is present and the thermal bridge is very small.

A cutout, which is shown in an enlarged manner, is also marked by a broken line in FIG. 4. The dimensions can be seen here in a more precise manner. In particular, it can be seen that the outermost planar edge 1*a* of the first vacuum insulation panel 1 contacts the large planar surface of the second vacuum insulation panel 2. The sealing edge of the second insulation panel 2 is only located opposite the edge over part of the surface of the edge. This does not pose a problem because a sufficiently narrow gap is additionally configured the planar surface.

Two different types of vacuum insulation panels are combined with one another in the transport container which is shown in FIG. 4. Combined here, in particular, are the first vacuum insulation panels 1 in the form of vacuum insulation panels with a previously pressed core material, in particular produced from pyrogenic silica, and the second vacuum insulation panels 2, configured as vacuum insulation panels with a bulk powder core or with a core produced from microfiber material. Reference may also be made in this respect to the prior art commended in the introduction.

With the proposed combination of different types of suitably chosen thermal insulation panels, it is possible to achieve a clear reduction in costs without having to make curtailments in the thermal insulation. The solution described here with the edges increases the service life of the transport container under working conditions by up to 20%.

If FIG. 3 and FIG. 4 are looked at together, it is possible to imagine that also provided in the outer container 5 of the transport container from FIG. 4 is that the second vacuum insulation panels 2 are configured as a connected U-shaped component with formed bending zones 4 on the second side walls 7 and on the bottom 6. In the exemplary embodiment shown in FIG. 4, this is the U-shaped component from FIG. 3. The second vacuum insulation panel 2 which is associated with the lid 8 is held separately and is placed in position from above prior to the closing of the outer container 5.

It is also possible to imagine that the vacuum insulation panel 2, which is associated with the lid 8 or the lids 8, is still also incorporated into the U-shaped component, which is shown in FIG. 3, by means of a corresponding bending zone 4. There is then the advantage of reducing the thermal bridges also in the region toward the lid 8.

Figure 5:
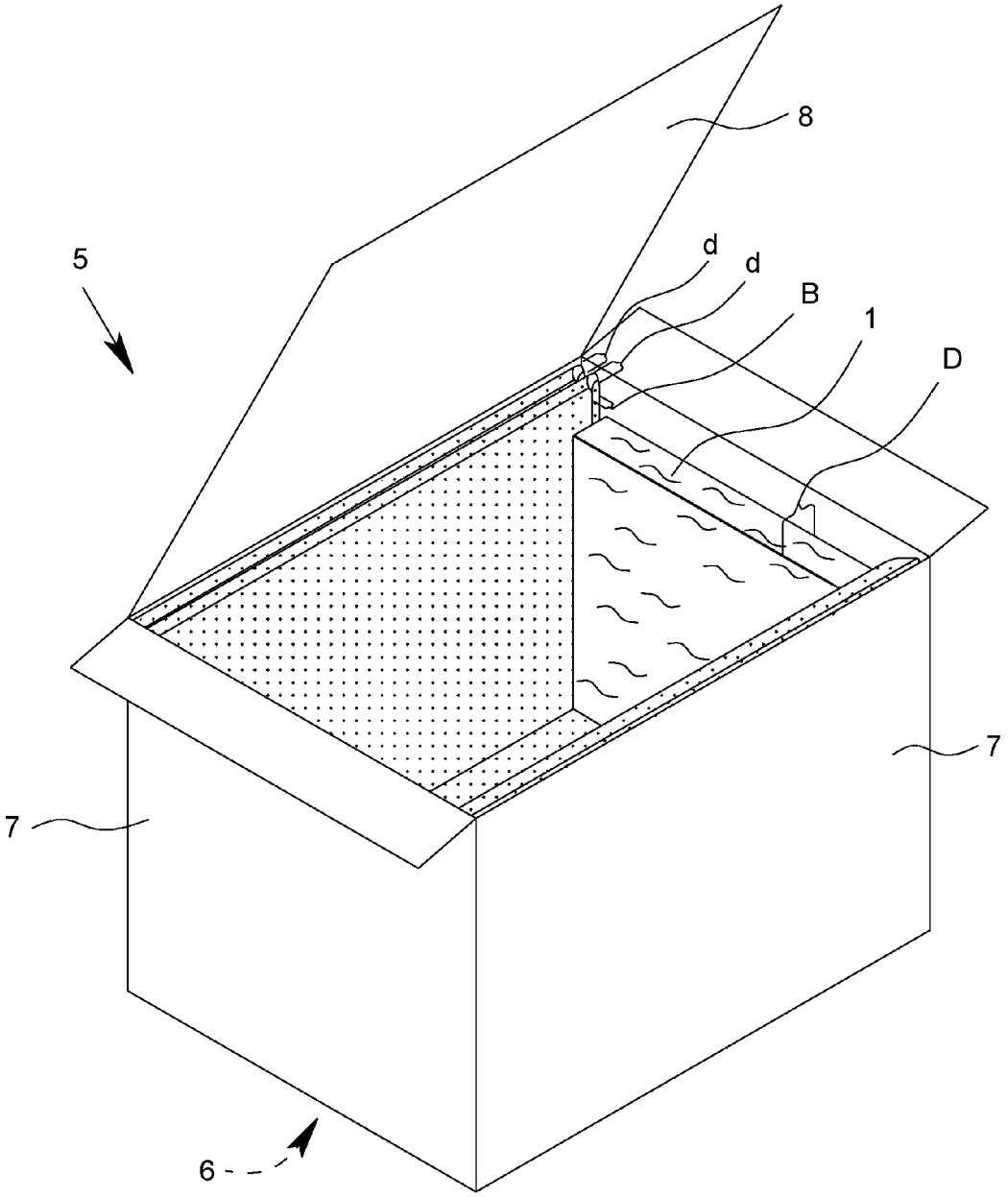
FIG. 5 shows a representation corresponding to FIG. 4 of a second exemplary embodiment of a transport container according to the invention, open.

FIG. 5, in a representation corresponding to FIG. 4, shows a further design of a transport container according to the invention which is distinguished as a result of the thickness d of the second vacuum insulation panels 2 which are combined here in the U-shaped component being considerably smaller than the thickness D of the first vacuum insulation panels 1 and preferably only approximately half as large as the thickness D of the first vacuum insulation panels 1. Here too, the second vacuum insulation panels 2 are configured as vacuum insulation panels with a sealing edge 3.

In the case of the particularly preferred exemplary embodiment in FIG. 5, in an expedient manner the second vacuum insulation panels 2 are configured in a relatively thin manner, but are in each case configured in a connected manner as a U-shaped component. So that the thickness does not become too large, two such U-shaped components are arranged in two layers in the outer container 5. This is also advantageous with regard to the efficiency of the use of space and with regard to the flexibility of the U-shaped components.

It is particularly expedient when the outer U-shaped component has slightly larger dimensions than the inner U-shaped component such that the outer U-shaped component is able to encompass the inner U-shaped component with accuracy of fit.

In the specific exemplary embodiment, it can be assumed that, corresponding to a preferred teaching of the invention, the thickness d is approximately between 10 mm and 15 mm, preferably approximately 12 mm and/or that the thickness D is approximately between 20 mm and 30 mm, preferably approximately 24 mm and/or that the width B is approximately between 3 mm and 15 mm.

Figure 6:
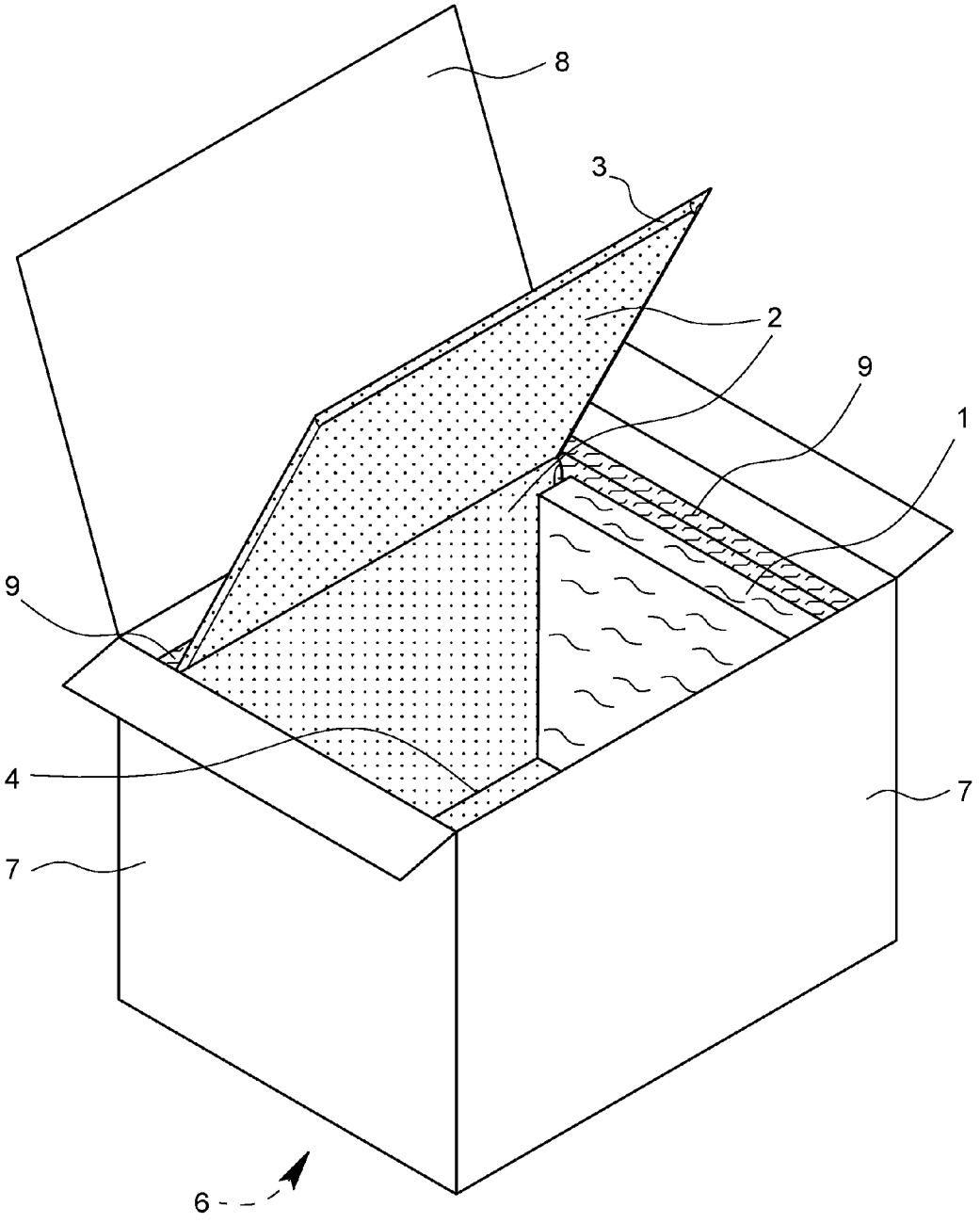
FIG. 6 shows a representation corresponding to FIG. 4 of a third exemplary embodiment of a transport container according to the invention, open.

FIG. 6 shows a further different embodiment of a transport container according to the invention. Here, the insulation is configured by means of the second vacuum insulation panels 2 by way of an O-shaped component, including the region of the lid 8. However, the insulation has only one layer at this point and not two layers. In place of a further outer layer produced from insulation material, it is provided in the case of the exemplary embodiment in FIG. 6 that on the inside of the outer container 5, insulation 9 which is produced from standard insulation material is arranged on the bottom 6, on the side walls 7 and on the lid 8 and that the vacuum insulation panels 1, 2 are arranged on the inside of the standard insulation 9. It can be seen in FIG. 6 that an inner container, which is injected from dense plastic foam material and produced from a standard insulation 9, is situated initially in the outer container 5 which consists here of a thin plastics material. The vacuum insulation panels 1, 2 are only situated therein.

The invention is particularly important in the case of transport containers which are configured so as to be transportable by air.

All embodiments disclosed herein can be used alone or in combination with each other.

LIST OF REFERENCES

1 First vacuum insulation panel
1*a* Outermost planar edges
2 Second vacuum insulation panel
3 Sealing edge
4 Bending zones
5 Outer container
6 Bottom
7 Side walls
8 Lid
9 Insulation

The invention claimed is:

1. A transport container having an outer container with a bottom, a set of first side walls which are located opposite one another, a set of second side walls which are located opposite one another and at right angles with the first side walls, and at least one lid and having vacuum insulation panels which are arranged on an inside of the outer container on the bottom, on the first and second side walls, and on the lid, wherein first vacuum insulation panels, which are arranged on an inside of the first side walls, have outermost planar edges which abut against innermost planar surfaces of second vacuum insulation panels, which are arranged on an inside of the second side walls, on the bottom, and on the lid, and wherein the second vacuum insulation panels are configured as vacuum insulation panels having a sealing edge having a different contour than the outermost planar edges of the first vacuum insulation panels, the sealing edge of the second vacuum insulation panels inserted in the outer container comprises a width B, the first vacuum insulation panels are configured as planar rectangular-shaped vacuum insulation panels with a thickness D, the thickness D is greater than the width B and the outermost planar edges of the first vacuum insulation panels cover the sealing edges of the second vacuum insulation panels.

2. The transport container as claimed in claim 1, wherein the thickness D is at least two times the width B.

3. The transport container as claimed in claim 1, wherein the second vacuum insulation panels are configured as vacuum insulation panels with a bulk powder core or with a core produced from microfiber material.

4. The transport container as claimed in claim 1, wherein the first vacuum insulation panels are configured as vacuum insulation panels with a core material, which has been pressed beforehand to form a block or to form a mechanically stable plate.

5. The transport container as claimed in claim 1, wherein the width B is between 3 mm and 15 mm.

6. The transport container as claimed in claim 1, wherein an insulation produced from standard insulation material is arranged on the inside of the outer container on the bottom, on the first and second side walls and on the lid and the vacuum insulation panels are arranged on an inside of the standard insulation material.

7. The transport container as claimed in claim 1, wherein the transport container is configured to be transportable by air.

8. The transport container as claimed in claim 1, wherein the first vacuum insulation panels cover open spaces defined by the sealing edges of the second vacuum insulation panels and lying within the width B.

9. A transport container having an outer container with a bottom, a set of first side walls which are located opposite one another, a set of second side walls which are located opposite one another and at right angles with the first side walls, and at least one lid and having vacuum insulation panels which are arranged on an inside of the outer container on the bottom, on the first and second side walls and on the lid, wherein first vacuum insulation panels, which are arranged on an inside of the first side walls, have outermost planar edges which abut against innermost surfaces of second vacuum insulation panels, which are arranged on an inside of the second side walls, on the bottom, and on the lid, wherein the second vacuum insulation panels are configured as vacuum insulation panels having a sealing edge having a different contour than the outermost planar edges of the first vacuum insulation panels, and wherein the second vacuum insulation panels are configured in a connected manner as a U-shaped component with formed bending zones on the second side walls and on the bottom or are configured in a connected manner as an O-shaped component with formed bending zones together with one of the second vacuum insulation panels on the lid.

10. The transport container as claimed in claim 9, wherein a thickness d of the second vacuum insulation panels combined in the U-shaped or O-shaped component is less than a thickness D of the first vacuum insulation panels.

11. The transport container as claimed in claim 10, wherein the thickness d is only half as large as the thickness D of the first vacuum insulation panels.

12. The transport container as claimed in claim 10, wherein two U-shaped or O-shaped components which correspond to one another are arranged in two layers in the outer container.

13. The transport container as claimed in claim 10, wherein the thickness d is between 10 mm and 15 mm.

14. The transport container as claimed in claim 13, wherein the thickness D is between 20 mm and 30 mm.

15. The transport container as claimed in claim 13, wherein the thickness d is 12 mm.

16. The transport container as claimed in claim 15, wherein the thickness D is 24 mm.

17. The transport container as claimed in claim 9, wherein the sealing edge is compressed.

18. The transport container as claimed in claim 9, wherein the first vacuum insulation panels and the second vacuum insulation panels are configured of different types of vacuum insulation panels.

19. A transport container having an outer container with a bottom, a set of first side walls which are located opposite one another, a set of second side walls which are located opposite one another and at right angles with the first side walls, and at least one lid and having vacuum insulation panels which are arranged on an inside of the outer container on the bottom, on the first and second side walls, and on the lid, wherein first vacuum insulation panels, which are arranged on an inside of the first side walls, have outermost planar edges which abut against innermost planar surfaces of second vacuum insulation panels, which are arranged on an inside of the second side walls on the bottom, and on the lid, wherein the second vacuum insulation panels are configured in a connected manner as a U-shaped component with formed bending zones on the second side walls and on the bottom or are configured in a connected manner as an O-shaped component with formed bending zones together with one of the second vacuum insulation panels on the lid, and wherein the second vacuum insulation panels are configured as vacuum insulation panels with a sealing edge having a different contour than the outermost planar edges of the first vacuum insulation panels, the sealing edge of the second vacuum insulation panels inserted in the outer container comprises a width B, the first vacuum insulation panels are configured as planar rectangular-shaped vacuum insulation panels with a thickness D, the thickness D is greater than the width B and the outermost planar edges of the first vacuum insulation panels cover the sealing edges of the second vacuum insulation panels.

20. The transport container as claimed in claim 19, wherein the thickness D is at least two times the width B.

21. The transport container as claimed in claim 19, wherein the second vacuum insulation panels are configured as vacuum insulation panels with a bulk powder core or with a core produced from microfiber material.

22. The transport container as claimed in claim 19, wherein the first vacuum insulation panels are configured as vacuum insulation panels with a core material, which has been pressed beforehand to form a block or to form a mechanically stable plate.

23. The transport container as claimed in claim 19, wherein a thickness d of the second vacuum insulation panels combined in the U-shaped or O-shaped component is less than a thickness D of the first vacuum insulation panels.

24. The transport container as claimed in claim 19, wherein the thickness D is between 20 mm and 30 mm.

25. The transport container as claimed in claim 19, wherein the width B is between 3 mm and 15 mm.

26. The transport container as claimed in claim 19, wherein the first vacuum insulation panels cover open spaces defined by the sealing edges of the second vacuum insulation panels and lying within the width B.

* * * * *